US006264350B1

(12) United States Patent
Swanson

(10) Patent No.: US 6,264,350 B1
(45) Date of Patent: Jul. 24, 2001

(54) DESK LAMP

(75) Inventor: Dennis K. Swanson, Woodland Hills, CA (US)

(73) Assignee: Pacific Coast Lighting, Chatsworth, CA (US)

( * ) Notice: Subject to any disclaimer, the term of this patent is extended or adjusted under 35 U.S.C. 154(b) by 0 days.

(21) Appl. No.: 09/270,424

(22) Filed: Mar. 16, 1999

(51) Int. Cl.[7] ..... F21S 1/12
(52) U.S. Cl. ..... 362/414; 362/410
(58) Field of Search ..... 362/410, 414, 362/287; D26/65, 66, 107

(56) References Cited

U.S. PATENT DOCUMENTS

| | | | | |
|---|---|---|---|---|
| D. 420,758 | * | 9/1998 | Yang | D26/65 |
| D. 426,009 | * | 5/2000 | Swanson | D26/65 |
| D. 426,337 | * | 6/2000 | Swanson | D26/65 |
| D. 426,907 | * | 6/2000 | Swanson | D26/65 |
| D. 428,178 | * | 7/2000 | Swanson | D36/62 |
| D. 429,535 | * | 8/2000 | Swanson | D26/66 |
| 1,966,485 | * | 7/1934 | Chanock | 362/414 |
| 3,133,703 | * | 5/1964 | Monroe | 362/410 |
| 5,155,667 | * | 10/1992 | Ho | 362/413 |
| 5,221,141 | | 6/1993 | Swanson | 362/250 |
| 5,620,247 | * | 4/1997 | Swanson | 362/414 |
| 5,690,426 | * | 11/1997 | Sherman | 362/410 |
| 5,800,054 | * | 9/1998 | Lo | 362/414 |
| 5,954,426 | * | 9/1999 | Whittington | 362/414 |

* cited by examiner

*Primary Examiner*—Thomas M. Sember
(74) *Attorney, Agent, or Firm*—Fulbright & Jaworski L.L.P.

(57) ABSTRACT

A desk lamp having both general area lighting and task lighting. The desk lamp includes a base and a stem extending from the base. The general area lighting is a reflector attached to the stem at an end opposite the base. Task lights are attached to the stem intermediate the base and the general area lighting. The overall height of the lamp from the base to the top of general area lighting is such that when the lamp is resting on a desk, an adult person of average height, when standing, will not be looking into the general area lighting.

2 Claims, 3 Drawing Sheets

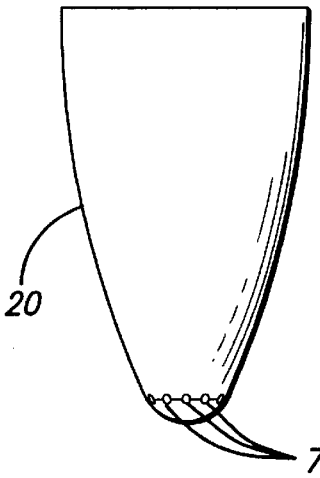
FIG. 2
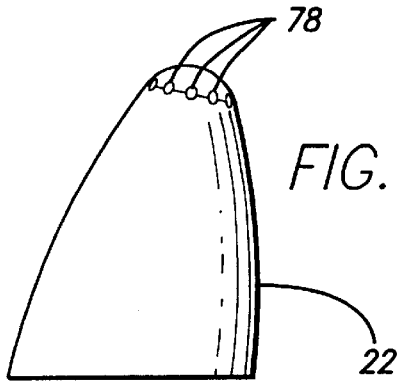
FIG. 3
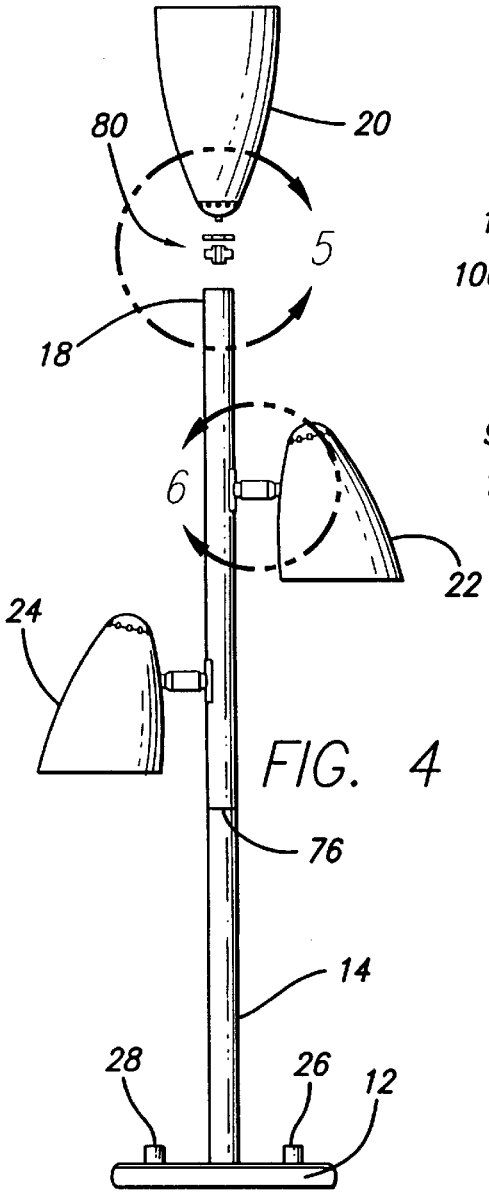
FIG. 4
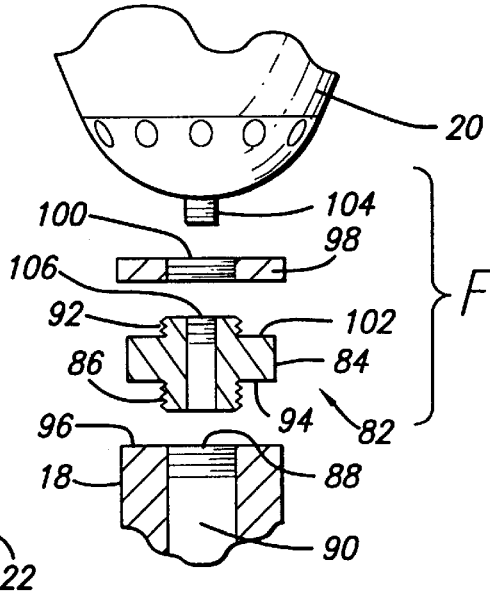
FIG. 5
FIG. 6
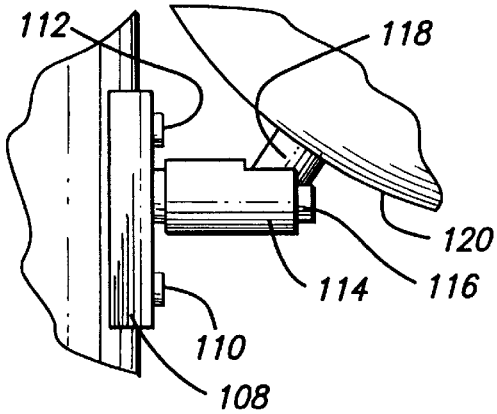

DESK LAMP

FIELD OF THE INVENTION

The present invention relates generally to electric lighting apparatus and, more particularly, to a desk lamp which includes the combination of general area lighting and task lighting to direct light onto the desk work area.

BACKGROUND OF THE INVENTION

Electric lighting apparatus in the form of floor lamps, table lamps and desk lamps is well known. Such lamps generally take the form of a general lighting device or alternatively, a task lighting device. In the recent past stand alone floor lamps having a combination of general lighting and task lighting on the same structure has been provided. Typical of such a structure is that disclosed in Applicant's U.S. Pat. No. 5,221,141. However, Applicant is unaware of any lamp structure designed to be placed on a desk top which provides the combination of general area lighting, as well as task lighting for use in and around the general work area of a desk or similar structure.

SUMMARY OF THE INVENTION

A desk lamp having both general area lighting and task lighting which includes a base member with a hollow stem having one end affixed thereto and having a general area lighting means affixed to the other end of said stem. The overall height of the desk lamp is such that an average adult when standing with the lamp disposed upon a desk will not look into the general area lighting means. The stem includes at least one light reflector affixed thereto intermediate the base and the general area lighting means directing light generally downward upon the desk work area.

BRIEF DESCRIPTION OF THE DRAWINGS

FIG. 2 is an elevational view of the general area light reflector means;

FIG. 3 is an elevational view of a task light reflector;

FIG. 4 is a partially exploded view of the desk lamp of the present invention;

FIG. 5 is illustrative of the connection of the general area lighting reflector to the stem and is taken about the lines 5—5, FIG. 4;

FIG. 6 is illustrative of the attachment of the task light to the stem and is taken about the line 6—6 of FIG. 4.

DETAILED DESCRIPTION

Figure 7:
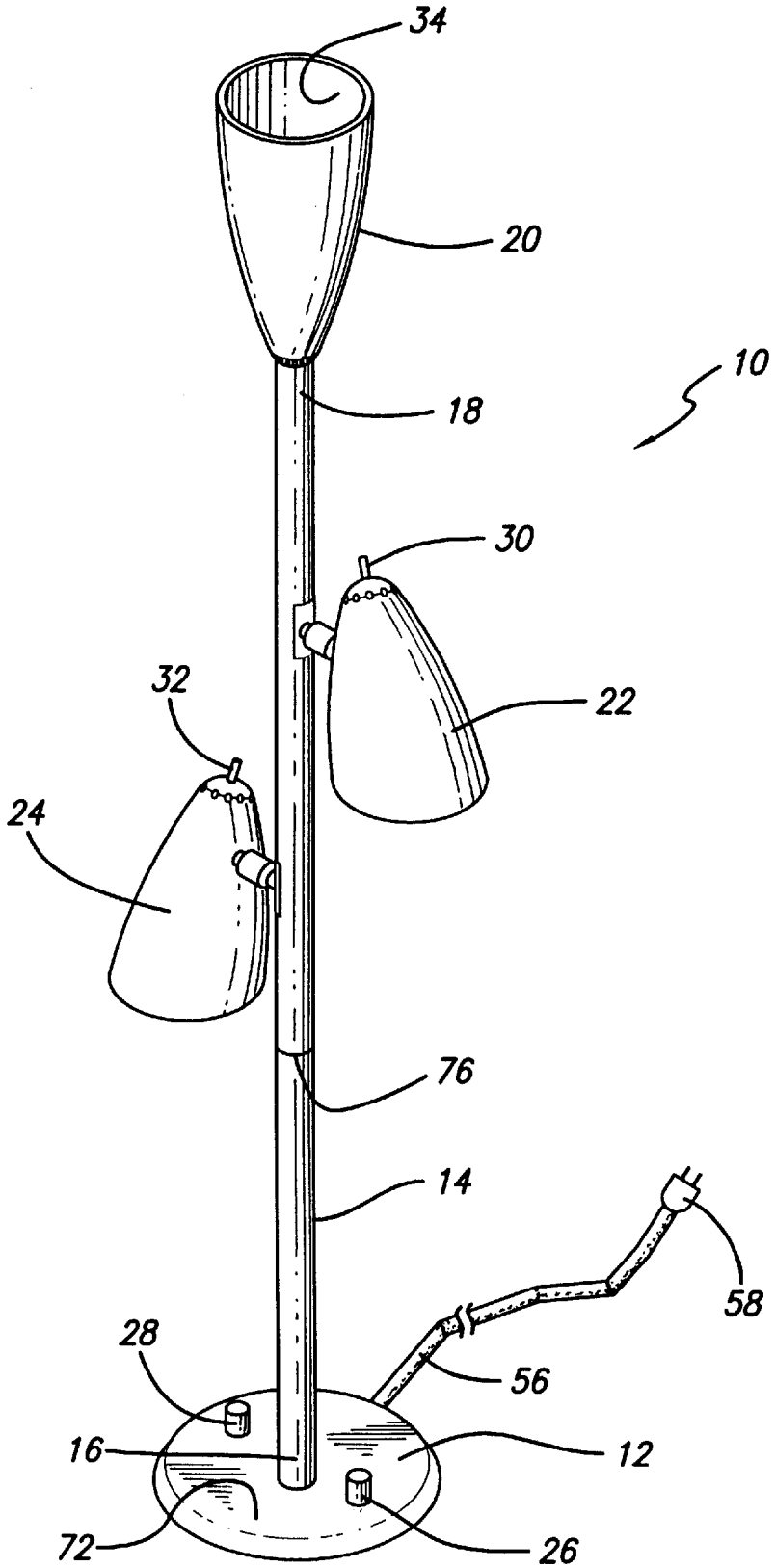
FIG. 7 is a perspective view of a desk lamp constructed in accordance with the principles of the present invention fully assembled and ready for use.

Referring to the drawings and more particularly to FIG. 7 thereof, there is illustrated a desk lamp 10 which is constructed in accordance with the principles of the present invention. The desk lamp 10 includes a base member 12 which is designed to provide stability to the lamp and is adapted to be easily placed upon the surface of a desk or similar working structure to support the lamp 10. A stem 14 having ends 16 and 18 protrudes centrally from the base 12. The end 16 of the stem 14 is detachably secured to the base 12. The opposite end 18 of the stem 14 has a general area lighting means 20 removably affixed thereto. The general area lighting means 20 generally takes the form of an upwardly directed reflector which will direct light emanating from a light bulb (not shown) disposed within the reflector 20 so that light will generally be projected into the area surrounding the desk and for example will reflect from the ceiling back into the area surrounding the desk to provide overall ambient light for both aesthetic and practical purposes. Any type of light source may be utilized such as incandescent, flourescent, halogen or the like well known to those skilled in the art.

To provide light directed specifically upon the work area of the desk, there are provided downwardly directed task light members 22 and 24. The task light members 22 and 24 may take the form of light reflectors which are connected to the stem 14 intermediate the ends 16 and 18 thereof. Preferably, the downwardly directed task light reflectors 22 and 24 are connected in such a manner that each of the reflectors may independently be manipulated to direct the light emanating therefrom upon a desired work area. Although two such downwardly directed reflectors 22 and 24 have been shown in FIG. 7, it should be understood that the desk lamp of the present invention may also be constructed with one, or more than two, such reflectors if such is desired without departing from the spirit or scope of the present invention.

As is the case with the general area lighting means 20, the source of illumination for the task lighting members 22 and 24 may be any known to the art such as incandescent, flourescent or halogen as may be desired in the particular application. Appropriate switch means such as shown at 26 and 28 are disposed upon and protrude from the base 12 and are used to turn the light bulbs appearing in the lighting means 20, 22 and 24 on and off and, if desired, may include dimmers to control the light level. Alternatively, individual switches may be incorporated into the task lights 22 and 24 as shown at 30 and 32. If such individual switches are utilized, then one of the switches 26 and 28 may take the form of a dimmer for such lights or alternatively may be eliminated altogether.

As above indicated, one of the primary features of the desk lamp as shown in FIG. 7 is that its overall height is such that when it is placed upon the work surface of a desk or table or similar work area, the opening 34 in the upwardly directed reflector 20 will generally be above the height of the average person so that such average person when standing will not be looking directly into the reflector and thereby directly at the light source which is disposed therein. It has been determined that the overall height from the floor upon which the desk rests to the top of the upwardly directed reflector 20 should be ideally approximately 68 inches. It is recognized that the work surface of most desks or tables upon which such a desk lamp would be placed are approximately 38 to 40 inches above the floor upon which they rest. Therefore, the overall height of the desk lamp as shown in FIG. 7 would ideally be between 28 and 30 inches from the bottom of the base 12 to the top of the upwardly directly reflector 20.

Figure 1:
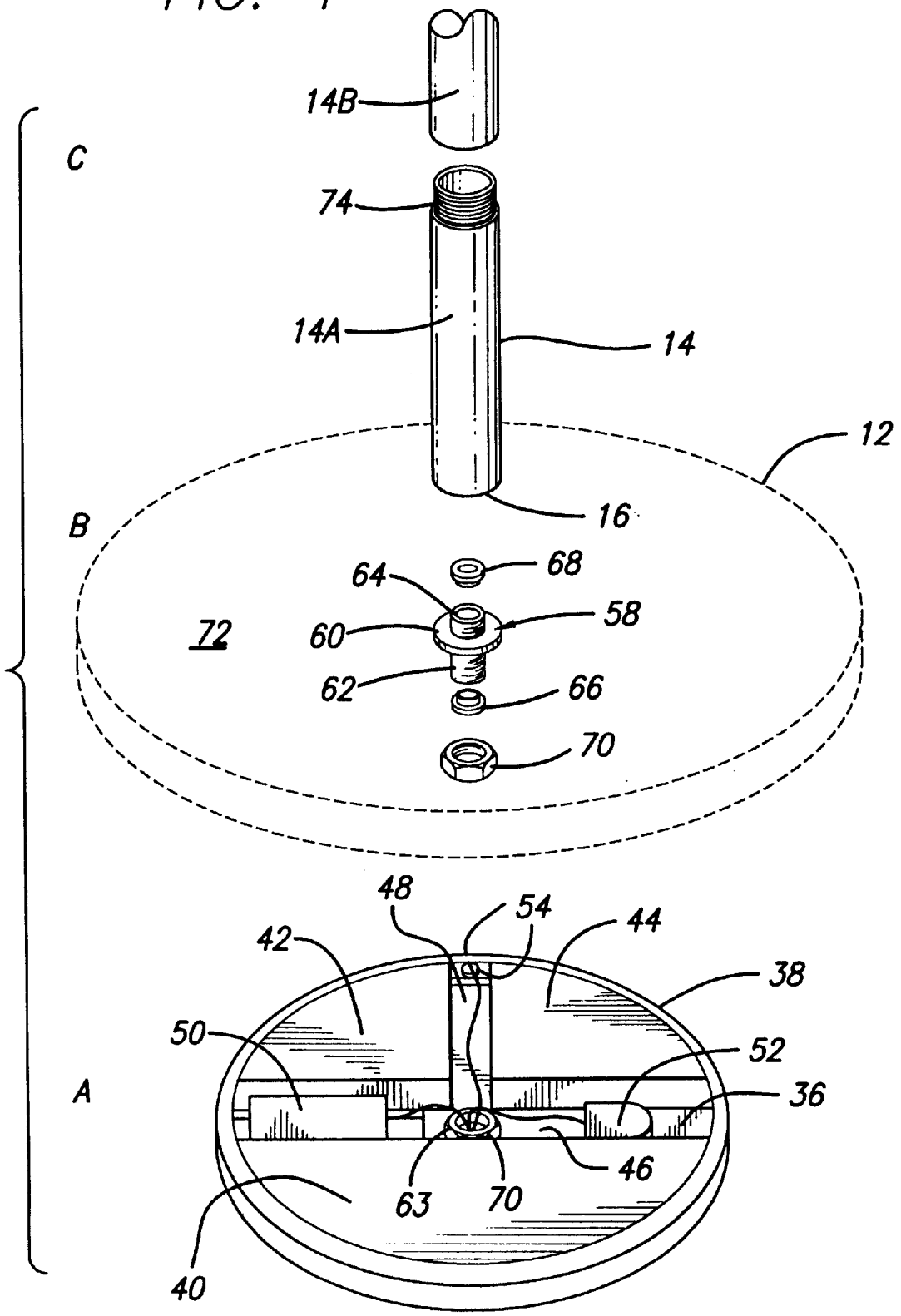
FIG. 1 is an exploded view illustrating the base and the attachment of the lower portion of the stem thereto.

By referring now more specifically to FIG. 1, the construction of the base 12 and the connection of the stem 14 thereto is illustrated in further detail. In FIG. 1A, the base 12 has been inverted and illustrated with a protective cover formed for example from felt or other material which will protect the surface ofthe desk removed. It should be recognized that the base 12 when inverted as shown at FIG. 1A takes the configuration of a relatively shallow dish which has a bottom 36 and an upstanding rim 38. Disposed within the interior formed between the base 36 and the inner surface of the rim 38 is material which is very dense and provides substantial weight to stabilize the lamp and prevent it from being easily tipped over in the event it is accidentally contacted by the user. As is illustrated in FIG. 1A, the dense material may take the form of three separate inserts 40, 42 and 44 made of lead or similar material. The three pieces of material are disposed so as to provide a first track 46 and a second track 48 which is perpendicular to and intersects the first track 46. The first track 46 receives the operational portions of the switches shown at 26 and 28 in FIG. 7. For example, the switch 26 may be a variable resistor which functions as a dimmer structure 50 which controls the level of light emanating from the task lights 22 and 24. Also disposed within the track 46 is a second dimmer and switch 52 which would control the light source in the general lighting area reflector 20. An opening 54 is provided in the upstanding rim 38 at the terminus of the second track 48. The opening 54 is used to permit the wiring 56 to pass outwardly from the base 12 so that a plug 58 may be inserted into a wall outlet or similar such apparatus (not shown) to attach the lamp to a source of electrical current. The sections of dense materials 40, 42 and 44 may be secured to the bottom or floor 36 of the base 12 by any means known to those skilled in the art. For example, an appropriate adhesive, such as epoxy, may be applied to the lead inserts 40, 42 and 44, as well as, to the floor or bottom 36 which when it sets securely and permanently attaches these inserts to the base 12.

At FIG. 1B, the base 12 is shown in its upright position as it is in FIG. 7 but is illustrated in dashed lines. To secure the end 16 of the stem 14 to the base 12, there is provided a fitting 56. The fitting 56 includes a knurled nut 58 having a flange 60. Extending downwardly from the flange 60 is a first hollow nipple 62 while extending upwardly therefrom is a second hollow nipple 64. The exterior surfaces of the nipples 62 and 64 are threaded as illustrated. A pair of bushings 66 and 68 are disposed at each end of the nipples 62 and 64, respectively, and are used to protect the wiring 56 which extends upwardly through the hollow stem 14 to the lights disposed in the light reflectors 20, 22 and 24. The nipple 62 is inserted through a central opening 63 in the base 12 and a nut 70 is threaded onto the threads on the exterior surface thereof to secure the knurled nut 58 in place upon the base 12. The nut 70 also secures the bushing 66 in place within the hollow central portion of the nipple 62. It will now be recognized by those skilled in the art that when the knurled nut 58 is secured in place by the nut 70 the upwardly protruding nipple 64 with the bushing 68 inserted therein extends above the upper surface 72 of the base 12. The interior of the stem 14 at the end 16 is threaded so that the stem 14 may be detachably threadably affixed to the base 12 by threading the end 16 onto the upwardly protruding nipple 64.

As is also illustrated at FIG. 1C, the stem 14 may be broken into two separate sections 14A and 14B with the upper end of the section 14A exteriorly threaded as shown at 74 and the interior of the lower portion of the section 14B threaded so that the sections 14A and 14B may be threadably secured together which is illustrated by the parting line 76. By utilization of the two separate sections 14A and 14B of the stem 14 as well as the threadable attachment of the lower portion 16 of the stem 14 to the upwardly standing nipple 64, the base may be separated from the stem and the stem may be broken into two separate sections which allows for easier packaging and transport of the desk lamp thereby saving cargo space.

Illustrated in FIG. 2 is a more detailed view of the structure of the reflector 20. Although the reflector 20 is generally shown as one-half of an ellipsoid such a shape is not essential and it may take any form desired and may be shaped or decorated in any manner desired. Similarly, the downwardly directed reflectors are shown in greater detail in FIG. 3 and although similar in shape to the upwardly directed reflector 20 such shape is not deemed a material part ofthe present invention. Generally for aesthetic purposes, the general area and task lighting reflectors will have generally the same geometric configuration. Again, however, this should not be construed as a limitation upon the present invention. One of the features of the present invention which is deemed important is that at the closed end of the reflectors there is provided a plurality of openings 76 and 78 to allow for the convective circulation of air thereby to reduce the amount of heat collected within the reflectors which heat is generated by activation of the light source contained therein.

As is shown generally at 80 in FIG. 4 and in greater detail in FIG. 5, the general area lighting reflector 20 may be attached to the upper end 18 of the stem 14 by means of an attachment structure 80. The attachment structure 80 may include a second knurled nut 82 having a flange 84. Extending downwardly from the flange 84 is a nipple 86, the exterior surface of which is threaded in such a manner as to engage threads 88 formed on the interior hollow section 90 of the stem 14 at the upper end 18 thereof. The knurled nut 82 will be threaded into the upper portion 18 of the stem 14 by engaging the threads 86 and 88 and tightening the nut down until the lower surface 94 of the flange 84 engages the upper surface 96 of the stem 14. Thereafter, a nut 98 which is internally threaded as shown at 100 is threaded upon the upper nipple 92 until it engages the upper surface 102 of the flange 84. Thereafter, the reflector 20 is attached by the use of a nipple 104 extending from the closed end thereof and which is connected to the light fixture (not shown) housed internally thereof into the threaded interior portion as shown at 106 of the upwardly extending nipple 92. When the nipple 104 has been threaded into the upwardly protruding nipple 92, the nut 98 may be reversed in its direction of rotation so as to jam against the lower portion of the reflector 20 and securely lock it in place.

As above indicated, the task lights 22 and 24 may be attached to the stem 14 in such a way that they may be adjustable as desired. One form of such adjustment is illustrated in FIG. 6. As is therein shown, a plate 108 which has been curved to conform to the exterior surface of the stem 14 is permanently secured to the stem 14 as by rivets or other fasteners such as screws 110 and 112. Extending from the plate 108 is a standoff 114. Alternatively, the standoff may be attached directly to the stem 14 as by welding or the like. Rotatively coupled to the standoff 114 is a hollow cylinder 116. The hollow cylinder 116 has an extension 118 connected thereto which in turn is affixed to the end surface 120 of the task light reflector. The standoff, cylinder and extension are hollow, so that the electrical wiring 56 can pass therethrough. Through the utilization of these rotary connections, the reflectors 22 and 24 may be adjusted as desired by the user to cast appropriate illumination upon the upper surface of the desk work area.

The present invention has been described as preferred embodiment as is illustrated in the accompanying drawings. However, it should be understood that the invention is not limited by such description and illustration but rather is measured by the scope of the claims appended hereto.

What is claimed is:

1. A desk lamp providing both general area lighting and task lighting to illuminate a desk work area comprising:

a base member having a hollow interior and including first and second spaced apart inserts of dense material permanently secured in said hollow interior and defining a recess there between;

a hollow stem having first and second ends;

a general area lighting means having a closed end affixed to said second end of said stem for directing light generally upwardly;

the overall height of said base, stem and general area lighting means being approximately between 28 and 30 inches so as to provide a height sufficient to prevent an average adult, when standing, from looking into said general area lighting means when said lamp is positioned upon a standard height desk;

at least one light reflector having a closed end affixed to said stem intermediate said first and second ends for directing light generally downwardly upon the desk work area; and switch means disposed within said recess between said inserts of dense material for controlling at least one of said general area and task lighting means.

2. A desk lamp as defined in claim 1 which further includes a third insert of dense material spaced apart from said first and second inserts of dense material to define a track and electrical wiring disposed within said track and extending through an opening in said base member.

* * * * *